United States Patent [19]

Sindlinger

[11] Patent Number: 4,600,861

[45] Date of Patent: Jul. 15, 1986

[54] FLUORESCENT LAMP CIRCUIT BREAKER

[75] Inventor: Ronald E. Sindlinger, Muncy, Pa.

[73] Assignee: GTE Products Corporation, Stamford, Conn.

[21] Appl. No.: 817,754

[22] Filed: Jan. 6, 1986

Related U.S. Application Data

[63] Continuation-in-part of Ser. No. 582,673, Feb. 23, 1984, abandoned.

[51] Int. Cl.[4] ..... H01J 7/44

[52] U.S. Cl. ..... 315/73; 315/74; 315/104; 315/106; 315/107; 337/31

[58] Field of Search ..... 315/73, 74, 104, 106, 315/50, 107; 337/31

[56] References Cited

U.S. PATENT DOCUMENTS

| | | | |
|---|---|---|---|
| 2,464,704 | 3/1949 | Martin | 315/104 |
| 2,492,575 | 12/1949 | Jacobsen | 315/106 |
| 3,679,932 | 7/1972 | Murphy | 315/106 |
| 4,052,687 | 10/1977 | Kimball et al. | 337/25 |
| 4,097,779 | 6/1978 | Latassa | 315/106 |
| 4,114,968 | 9/1978 | Latassa | 316/1 |
| 4,156,831 | 5/1979 | Cassidy et al. | 315/106 |
| 4,171,519 | 10/1979 | Cassidy et al. | 337/25 |
| 4,329,621 | 5/1982 | Barakitis | 315/106 |

*Primary Examiner*—Harold Dixon

*Attorney, Agent, or Firm*—Carlo S. Bessone

[57] ABSTRACT

A rapid-start fluorescent lamp includes a pair of spaced electrodes within an envelope with one electrical lead connected to an electrode and the other lead coupled to the electrode by a thermally-sensitive bi-metal strip whereby one end of the bi-metal and one end of a conductor are formed to provide a straight member within a U-shaped member such that the straight U-shaped members are in electrical contact at temperatures above and below a given range of temperatures and electrically disconnected at the given range of temperatures.

10 Claims, 5 Drawing Figures

FLUORESCENT LAMP CIRCUIT BREAKER

This application is a continuation-in-part of application Ser. No. 582,673, filed Feb. 23, 1984, now abandoned.

CROSS REFERENCE TO OTHER APPLICATIONS

The following applications relate to rapid-start fluorescent lamps and bi-metal type circuit breakers especially suitable to such lamps: U.S. Ser. Nos. 520,866; 520,865; 520,861; 520,863; 520,862 and 582,672 filed concurrently herewith.

TECHNICAL FIELD

The invention relates to rapid-start fluorescent lamps and more particularly to bi-metal circuit breakers and rapid-start fluorescent lamps employing bi-metal circuit breakers wherein heater current flow is effected above and below a given range of temperatures.

BACKGROUND ART

Generally, the two common forms of fluorescent lamps are the so-called "preheat" type and the "rapid-start" type. The preheat type of fluorescent lamp has heater current flow therethrough during lamp ignition and thereafter a voltage-sensitive starter, external of the lamp, opens and discontinues the above-mentioned heater current flow. However, the "rapid-start" type of fluorescent lamp normally has current flow through each electrode not only during ignition but also during the operational period of the lamp. Thus, it can readily be seen that this continuous flow of heater current during operation of the rapid-start lamp is a cause for power loss in the system and an obvious and undesired cause for reduced operational efficiency.

In an effort to improve the energy efficiency of rapid-start fluorescent lamps, numerous suggestions and structural configurations have been suggested. For example, U.S. Pat. Nos. 4,052,687; 4,097,779; 4,114,968; 4,156,831; and 4,171,519 all of which are assigned to the assignee of the present application, provide numerous configurations for enhancing the operation of rapid-start fluorescent lamps. Primarily, each of the above-listed patents relates to rapid-start fluorescent lamps or bi-metal type circuit breakers for fluorescent lamps whereby heater current flow is discontinued during lamp operation.

Although each one of the above-listed structures and techniques enhances and provides numerous advantages over prior known configurations and processes, it has been found that problems remain. More specifically, it has been found that bi-metal type circuit breakers ordinarily require an electrical shunting material short-circuiting the leads of the circuit breaker during the rapid-start fluorescent lamp manufacturing process. During lamp processing, the circuit breaker is subjected to temperatures sufficiently high (about 300° C.) which maintains the circuit breaker open. Since the electrode of the fluorescent lamp includes a coating which requires activation during lamp manufacture, it is necessary for the electrode to be electrically heated by electrode current therethrough during this time. Therefore, it has been found necessary to provide a means for essentially removing the circuit breaker effect from the structure (e.g., by short-circuiting) until after the emissive materials of the electrode have been activated.

In order to accomplish the above-mentioned emissive material activation, the above-described electrical shunt is short-circuited across the circuit breaker to permit current flow to the electrode. However, once the emissive materials on the electrode have been processed it is necessary to remove the electrical shunt and re-activate the bi-metal circuit breaker employed with the rapid-start fluorescent lamp.

Although such structures have been and still are employed with relatively good results, it has been found that a circuit breaker wherein an electrical shunt is required does present problems of extra materials, added labor, increased defects and reduced productivity all of which increases cost and reduces manufacturing efficiency. Moreover, lamp processing introduces numerous oxidation problems associated with correct sealing of the envelope surrounding the bi-metal switch configuration.

OBJECTS AND SUMMARY OF THE INVENTION

An object of the present invention is to provide an enhanced bi-metal type circuit breaker. Another object of the invention is to provide an improved rapid-start fluorescent lamp. Still another object of the invention is to provide an enhanced rapid-start fluorescent lamp having increased efficiency. A further object of the invention is to provide a bi-metal type circuit breaker which is simple and inexpensive to manufacture and requires neither the presence or removal of a shunting material short-circuiting the circuit breaker electrical conductors.

These and other objects, advantages and capabilities are achieved in one aspect of the invention by a rapid-start fluorescent lamp having a circuit breaker therein with a bi-metal strip having first and second end portions and first and second electrical conductors sealed into and passing through an envelope with the first end portion of the bi-metal strip affixed to the first electrical conductor and the second end portion of the bi-metal strip and the second electrical conductor being formed to provide a straight member extending within a U-shaped member whereby connection between straight and U-shaped members is effected at temperatures above and below a given range of temperatures.

In another aspect of the invention, a circuit breaker includes a pair of electrical conductors sealed into and passing through a glass envelope and a bi-metal strip within the envelope having a first end portion affixed to one electrical conductor and a second end portion and second electrical conductor formed to provide a straight member within a U-shaped member and responsive to envelope temperature above a given range of temperatures for effecting electrical contact between the straight and U-shaped members.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
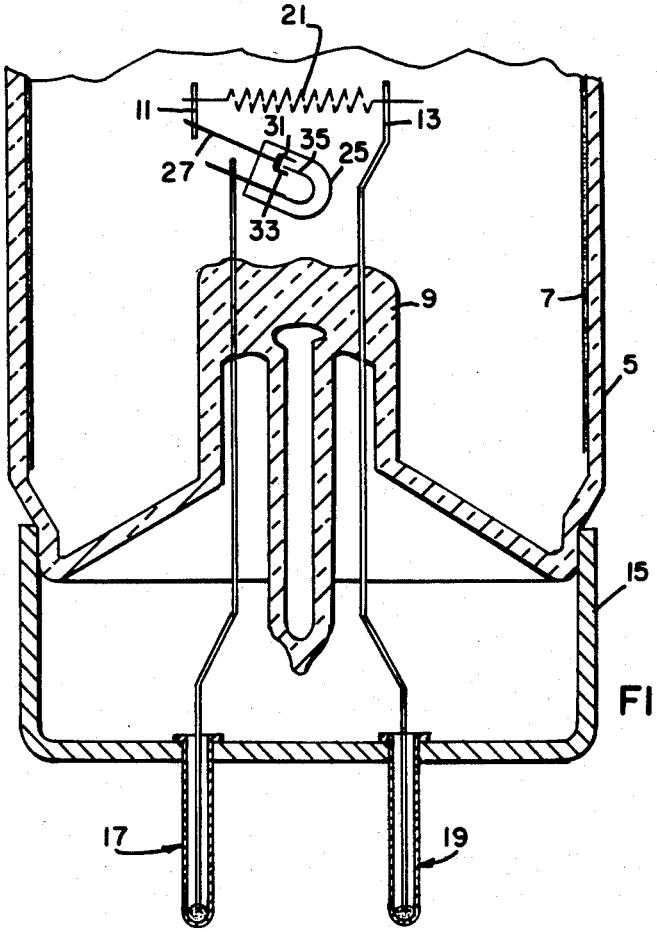
FIG. 1 is an elevational view, partially in section, of one end of a rapid-start fluorescent lamp having a circuit breaker therein.

Referring to FIG. 1 of the drawings, a rapid-start fluorescent lamp includes an elongated glass envelope 5 having a coating of phosphor 7 on the inner wall surface of the envelope 5. A glass stem member 9 is sealed into the end of the envelope 5 and a pair of electrical leads 11 and 13 preferably of nickel-plated dumet, are sealed into and pass through the stem member 9. An end cap 15 is telescoped over and attached to the glass envelope 5 and a pair of pins 17 and 19 are affixed to the end cap 15 and to the electrical leads 11 and 13 to provide electrical connection to an external source (not shown). Also, the envelope 5 has a fill gas therein selected from the group consisting of argon, krypton, neon, helium and combinations thereof.

An electrode 21 is located within the envelope 5 and has opposite ends thereof connected to the electrical leads 11 and 13. Thus, the longitudinal axis of the electrode 21 is in a direction substantially normal to the direction of the electrical leads 11 and 13. Moreover, this electrode 21 is frequently referred to as a filament or cathode and of a well known type used in rapid-start fluorescent lamps and usually includes a tungsten coil having a coating thereon in the form of alkaline earth oxides which are applied in the form of carbonates and processed to provide oxides.

Disposed within the envelope 5 is a thermally-sensitive bi-metal circuit breaker 23. The circuit breaker 23 is preferably in the form of a glass bottle or bulb 25. A pair of electrical conductors 27 and 29 are sealed into and pass through the glass bulb 25 with one of the electrical conductors 27 connected to the electrical lead 11 and the other electrical conductor 29 connected to the electrode 21.

Referring more specifically to the circuit breaker 23, one of the electrical leads 27 may be formed in a U-shaped configuration having first and second up-standing leg members 31 and 33. Also, a straight member 35, formed of thermally-sensitive bi-metal material, is affixed to the other electrical lead 29 sealed into the envelope 25. Moreover, the straight member 35 extends to a location intermediate the up-standing leg members 31 and 33.

Figure 2:
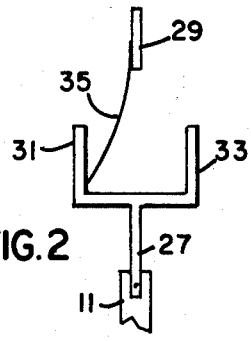
FIGS. 2–4 illustrate operational configurations of the circuit breaker of FIG. 1.
Figure 3:
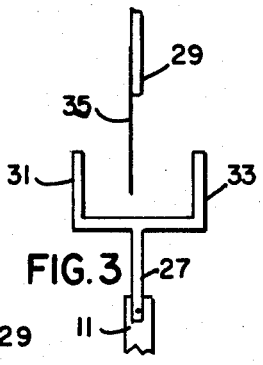
Figure 4:
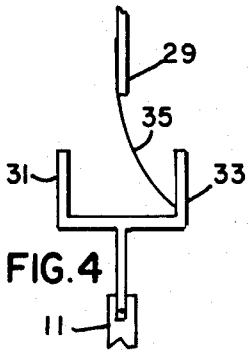

As can more readily seen in the illustrations of FIGS. 2–4, the thermally-sensitive bi-metal straight member 35 is formed to electrically contact one of the up-standing leg members 31 at a time when the bottle or bulb is at an ambient temperature such as a temperature of about 25° C. As the temperature of the bottle or bulb 25 is raised to a given range of temperatures, about 140° to 180° C. for example during the operational period of the lamp, the electrical contact between the straight member 35 and the U-shaped configuration is no longer present. The temperature of the bulb is raised higher than the previously-mentioned given range of temperature during bulb sealing and lamp manufacture, to about 300° C. for instance, causing the straight member 35 to electrically contact the other up-standing leg member 33 of the U-shaped configuration in order to permit current flow for activation of the emissive materials of the electrode.

Figure 5:
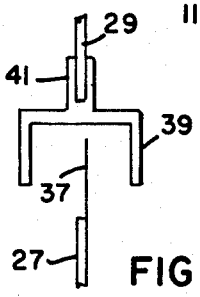
FIG. 5 is an alternate embodiment of the circuit breaker of FIG. 1.

Accordingly, the circuit breaker 23 may also be of a configuration wherein the electrical conductor 27 is formed to provide a straight member 37 (FIG. 5). Also, the U-shaped member 39 of the electrical lead material 41 is formed such that the straight member 37 is located therein. Thus, the apperature operates in a manner similar to the previously described operation wherein the straight member 37 and the U-shaped member 39 are in electrical contact at bulb temperatures below a given range of bulb temperatures and in contact above said given range of bulb temperature due to bulb sealing and lamp manufacture. There is no electrical connection there-between at the given range of bulb temperatures.

Thus, a rapid-start fluorescent lamp has been provided wherein is disposed a thermally-sensitive bi-metal circuit breaker of simplified and inexpensive construction. The structure is especially easy to manufacture and enhances the operation of the fluorescent lamp by eliminating the use of heating current for the electrodes during the operational period of the lamp.

While there have been shown what are at present considered to be preferred embodiments of the invention, it will be apparent to those skilled in the art that various changes and modifications can be made herein without departing from the scope of the invention as defined by the appended claims.

I claim:

1. A circuit-breaker for use in a rapid-start fluorescent lamp comprising:

a bulb;

first and second electrical conductors sealed into and passing through said bulb; and a thermally-sensitive bi-metal strip disposed within said bulb and having first and second end portions, said first end portion being affixed to said first electrical conductor and said second end portion and said second electrical conductor being formed to provide a straight member extending within a U-shaped member having first and second leg members with said straight member and said first leg member electrically connected at ambient bulb temperature and electrically disconnected at a given range of temperatures higher than ambient bulb temperature and said straight member and said second leg member electrically connected at a bulb temperature higher than said given range of bulb temperatures.

2. The circuit-breaker of claim 1 wherein said straight member is formed by said second end portion of said bi-metal strip and said U-shaped member is formed by said second electrical conductor.

3. The circuit breaker of claim 1 wherein said straight member is formed by said second electrical conductor and said U-shaped member is formed by said second end portion of said bi-metal strip.

4. The circuit breaker of claim 1 wherein said ambient bulb temperature is about 25° C., said given range of bulb temperatures is about 140° to 180° C. and said temperature higher than said given range of bulb temperatures for effecting electrical connection between said straight and U-shaped members is about 300° C.

5. A rapid-start fluorescent lamp comprising:

a glass envelope having a phosphor-coated inner wall surface;

a pair of spaced electrodes positioned within said envelope;

a pair of electrical leads for each of said electrodes sealed into and passing through said envelope with one of said pair of electrical leads directly connected to one of said electrodes; and a circuit breaker disposed within each end of said envelope and coupling the other one of said pair of electrical leads to said electrode, said circuit breaker including a glass bulb, first and second electrical conductors sealed into and passing through said bulb, a thermally sensitive bi-metal strip within said bulb and having first and second end portions with said first end portion affixed to said first electrical conductor and said second end portion of said bi-metal strip and said second electrical conductor being formed to provide a straight member extending within a U-shaped member having first and second leg members, said straight member and said first leg member being electrically connected at ambient bulb temperature, said straight member and said U-shaped member being electrically disconnected at a given range of bulb temperatures and said straight member and said second leg members being electrically connected at bulb temperatures higher than said given range of bulb temperatures given range of bulb temperatures, said bulb temperatures higher than said given range of bulb temperatures occurring during the manufacturing process of said fluorescent lamp.

6. The rapid-start fluorescent lamp of claim 5 wherein said straight member of said circuit breaker is formed from said second end portion of said bi-metal strip and said U-shaped member is formed from said second electrical conductor.

7. The rapid-start fluorescent lamp of claim 5 wherein said U-shaped member of said circuit breaker is formed from said second end portion of said bi-metal strip and said straight member is formed from said second electrical conductor.

8. The rapid-start fluorescent lamp of claim 5 wherein said ambient bulb temperature is about 25° C.

9. The rapid-start fluorescent lamp of claim 5 wherein said given range of bulb temperature is a range of about 140° to 180° C.

10. The rapid-start fluorescent lamp of claim 5 wherein said bulb temperatures higher than said given range of bulb temperatures is about 300° C.

* * * * *